US008444451B2

(12) United States Patent
Zhang

(10) Patent No.: US 8,444,451 B2
(45) Date of Patent: May 21, 2013

(54) PUPPET

(76) Inventor: Wen Zhang, Nanjing (CN)

( * ) Notice: Subject to any disclaimer, the term of this patent is extended or adjusted under 35 U.S.C. 154(b) by 263 days.

(21) Appl. No.: 12/925,721

(22) Filed: Oct. 28, 2010

(65) Prior Publication Data

US 2012/0108141 A1 May 3, 2012

(51) Int. Cl.
*A63H 3/14* (2006.01)

(52) U.S. Cl.
USPC ..... 446/327; 446/268; 446/321

(58) Field of Classification Search
USPC ..... 446/327, 71–76, 359–367, 268, 369, 446/321, 372
See application file for complete search history.

(56) References Cited

U.S. PATENT DOCUMENTS

| | | | | |
|---|---|---|---|---|
| 1,966,986 | A * | 7/1934 | Martin | 446/321 |
| 2,302,349 | A * | 11/1942 | Renshaw | 446/327 |
| 2,756,448 | A * | 7/1956 | Werbe | 446/327 |
| 3,521,399 | A * | 7/1970 | Deal | 446/73 |
| 3,737,196 | A * | 6/1973 | Bodor | 446/73 |
| 3,778,925 | A * | 12/1973 | Owen | 446/74 |
| 3,864,871 | A * | 2/1975 | Kaelin | 446/327 |
| 3,961,439 | A * | 6/1976 | Moustakas | 446/321 |
| 4,010,570 | A * | 3/1977 | Kohler | 446/327 |
| 4,107,873 | A * | 8/1978 | Bauer | 446/321 |
| 4,614,505 | A * | 9/1986 | Schneider et al. | 446/321 |
| 4,695,264 | A * | 9/1987 | McLeod, Jr. | 446/321 |
| 4,795,398 | A * | 1/1989 | Wexler | 446/327 |
| 4,842,565 | A * | 6/1989 | VonPhilp, Sr. | 446/321 |
| 5,084,930 | A * | 2/1992 | Danova | 5/502 |
| 5,090,938 | A * | 2/1992 | Reynolds | 446/369 |
| 5,115,528 | A * | 5/1992 | Lamle | 5/640 |
| 5,149,289 | A * | 9/1992 | Edwards et al. | 446/321 |
| 5,389,028 | A * | 2/1995 | Cabrera et al. | 446/73 |
| 5,472,364 | A * | 12/1995 | Castleman | 446/71 |
| 5,738,559 | A * | 4/1998 | Ostrar | 446/100 |
| 5,791,963 | A * | 8/1998 | Lieberman | 446/27 |
| 6,126,507 | A * | 10/2000 | Lieberman | 446/327 |
| 6,261,149 | B1 * | 7/2001 | Moore | 446/369 |
| 6,514,118 | B1 * | 2/2003 | Bart et al. | 446/321 |
| 2006/0057933 | A1 * | 3/2006 | Bricker et al. | 446/327 |
| 2008/0032592 | A1 * | 2/2008 | Korbonski | 446/297 |
| 2012/0073032 | A1 * | 3/2012 | Tigan et al. | 446/376 |

FOREIGN PATENT DOCUMENTS

| | | | |
|---|---|---|---|
| DE | 10031408 | A1 * | 12/2001 |
| FR | 2649330 | A1 * | 1/1991 |
| JP | 2010046268 | A * | 3/2010 |

* cited by examiner

*Primary Examiner* — Gene Kim
*Assistant Examiner* — Urszula M Cegielnik
(74) *Attorney, Agent, or Firm* — Tod R. Nissle, P.C.

(57) ABSTRACT

A hand operated puppet includes a pair of characters that are interconnected such that when the first character is in a display orientation the other character is in a storage orientation inside the first character. The head of one character is shaped and dimensioned to compressibly store the head of the other character. The head of each character includes an elastic, resilient foam insert shaped and dimensioned to conform to the contour of the face of the character.

1 Claim, 7 Drawing Sheets

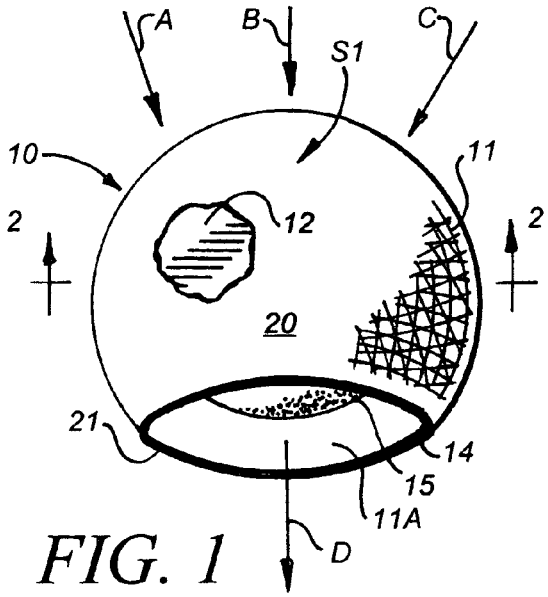
FIG. 1
FIG. 2
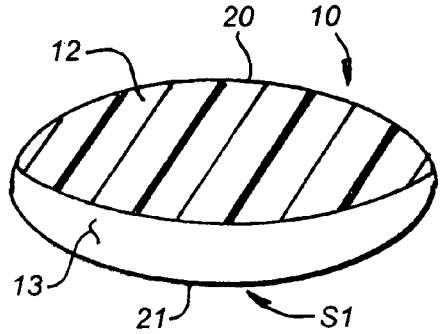
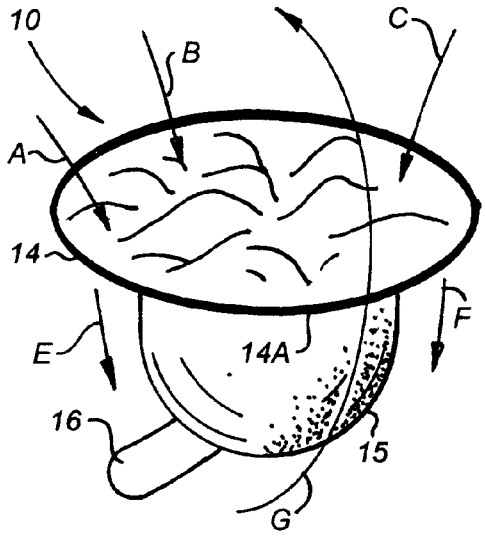
FIG. 3
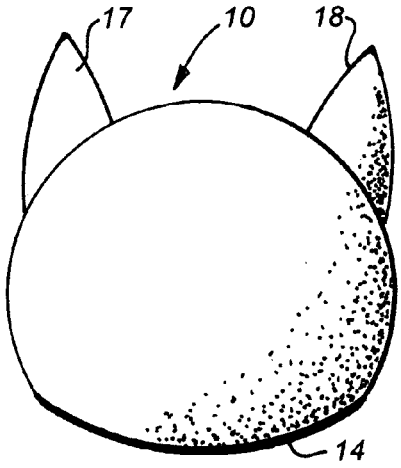
FIG. 4

PUPPET

This invention relates to toys.

More particularly, the invention relates to hand mounted and operated toys having multiple configurations.

Hand mounted and operated puppets are well known. It has long been a desired object to those skilled in the art to develop new and improved puppets.

Accordingly, it is an object of the invention to provide an improved hand manipulated puppet.

This and other, further and more specific objects of the invention will be apparent to those skilled in the art from the following detailed description thereof, in conjunction with the drawings, in which:

FIG. 1 is a perspective front view illustrating a first head unit and a first ovate neck band in a storage configuration with the face concealed inside the head unit, said first head unit utilized in constructing a first puppet character in accordance with the invention;

FIG. 2 is a section view of the head unit of FIG. 1 taken along section lines 2-2 and illustrating further construction details thereof;

FIG. 3 is a perspective view of the head unit and ovate neck band of FIG. 1 illustrating the mode of operation while the head unit is being turned inside-out to a display configuration in which the face of the head unit is visible;

FIG. 4 is a back view illustrating the head unit and ovate neck band of FIG. 1 after the head unit has been completely turned inside-out to the display configuration in which the face and back of the head of the head unit are visible;

Figure 5:
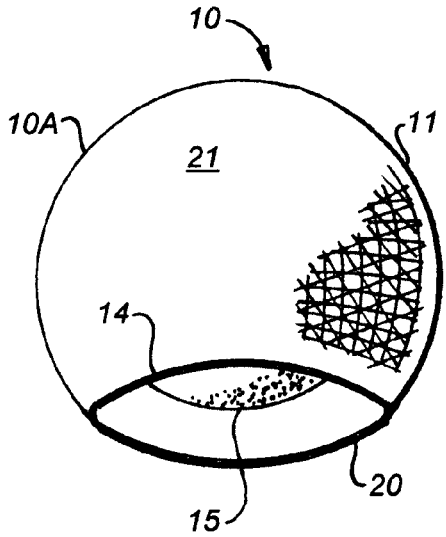
FIG. 5 is a perspective rear view illustrating the first head unit and first ovate neck band in the storage configuration of FIG. 1 after the head unit and neck band have been rotated one hundred and eighty degrees around a vertical axis parallel to arrows B and D in FIG. 1.

Briefly, provided is an improved hand operated invertible puppet toy. The toy comprises a first hollow invertible sleeve circumscribing a first open space and having an open first upper end and an open first lower bottom hem end and shaped and dimensioned to receive a user's hand and including a first side and a second side; and, first and second invertible hollow arms circumscribing a second open space and a third open space, respectively. The arms are each connected to the first sleeve such that the second and third open spaces each open into the first open space; are each shaped and dimensioned to receive a different finger of a user's hand and include a first side and a second side; and, each have a distal end.

The toy also includes a first ovate neck band that is connected to the first upper end of the first sleeve, and that circumscribes a first opening having a first selected size; and, includes a first pliable compressible resilient head unit.

The first head unit includes a first pliable skin that is connected to and extending outwardly from the neck band, that has a primary side and a secondary side, and that has a face formed on the primary side. The first head unit has a second size greater than the first selected size, and has a first compressible foam portion. The first head unit is compressible to reduce resiliently the second size and pass through the neck band between a first operative position and a second operative position. In the first operative position the first face and the primary side are concealed inside the skin, and the secondary side faces outwardly and is visible to a user on the exterior of the first head unit.

In the second operative position the head unit is inside-out from the first operative position and the first face and the primary side face outwardly and are visible to a user on the exterior of the first unit. In the secondary side is concealed inside the skin, and, there is a first hollow that is inside and circumscribed by the skin.

The toy also includes a second hollow invertible sleeve circumscribing a fourth open space and having an open first upper end and an open first lower bottom hem end and shaped and dimensioned to receive a user's hand and including a first side and a second side; and, includes third and fourth invertible hollow arms circumscribing a fifth open space and a sixth open space, respectively. Each of the third and fourth arms is connected to the second sleeve such that the fifth and sixth open spaces each open into sad fourth open space; is shaped and dimensioned to receive a different finger of a user's hand; includes a first side and a second side; and, has a distal end.

The toy also includes a second ovate neck band that is connected to the first upper end of the second sleeve, and that circumscribes a second opening having a third selected size; and, includes a second pliable compressible resilient head unit.

The second head unit includes a second pliable skin connected to and extending outwardly from the second neck band, that has a first side and a second side, and that has a second face formed on the first side. The second head unit has a fourth size greater than the third selected size, and has a second compressible foam portion. The second heat unit compresses to reduce resiliently the fourth size to pass through the second opening of the second neck band between a primary and a secondary operative position. In the primary operative position the second face and the first side of the second skin are concealed inside said second skin, and the second side of the second skin faces outwardly and is visible to a user on the exterior of the second head unit. In the secondary operative position, the second head unit is inside-out from the primary operative position with the second face and the first side facing outwardly and visible to a user on the exterior of the second head unit; the second side is concealed inside the second skin; and, a second hollow is circumscribed by the second skin.

The first head unit is attached and opposed to the second head unit, the distal end of each of the first and second arms is attached to the distal end of a different one of the third and fourth arms, and the hem end of the'first sleeve is attached to the hem end of the second sleeve such that the toy is invertible between an initial operational position and a second operational position.

In the initial operational position the first face faces outwardly and is visible and the second head unit is inside the first head unit concealed in the first hollow in the first head unit.

In the second operational position, the second face faces outwardly and is visible and the first head unit is inside the second head unit concealed in the second hollow in the second head unit.

Figure 9:
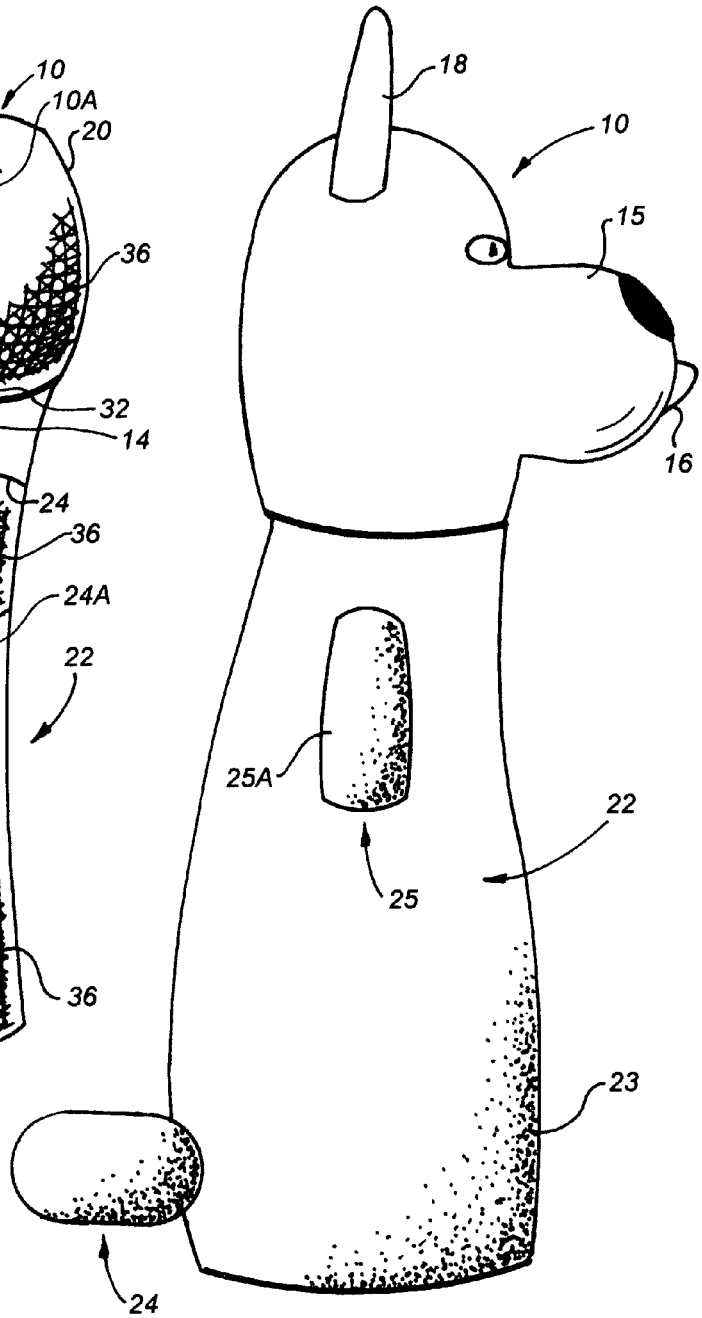
FIG. 9 is a side view of the first puppet character in its display configuration.
Figure 11:
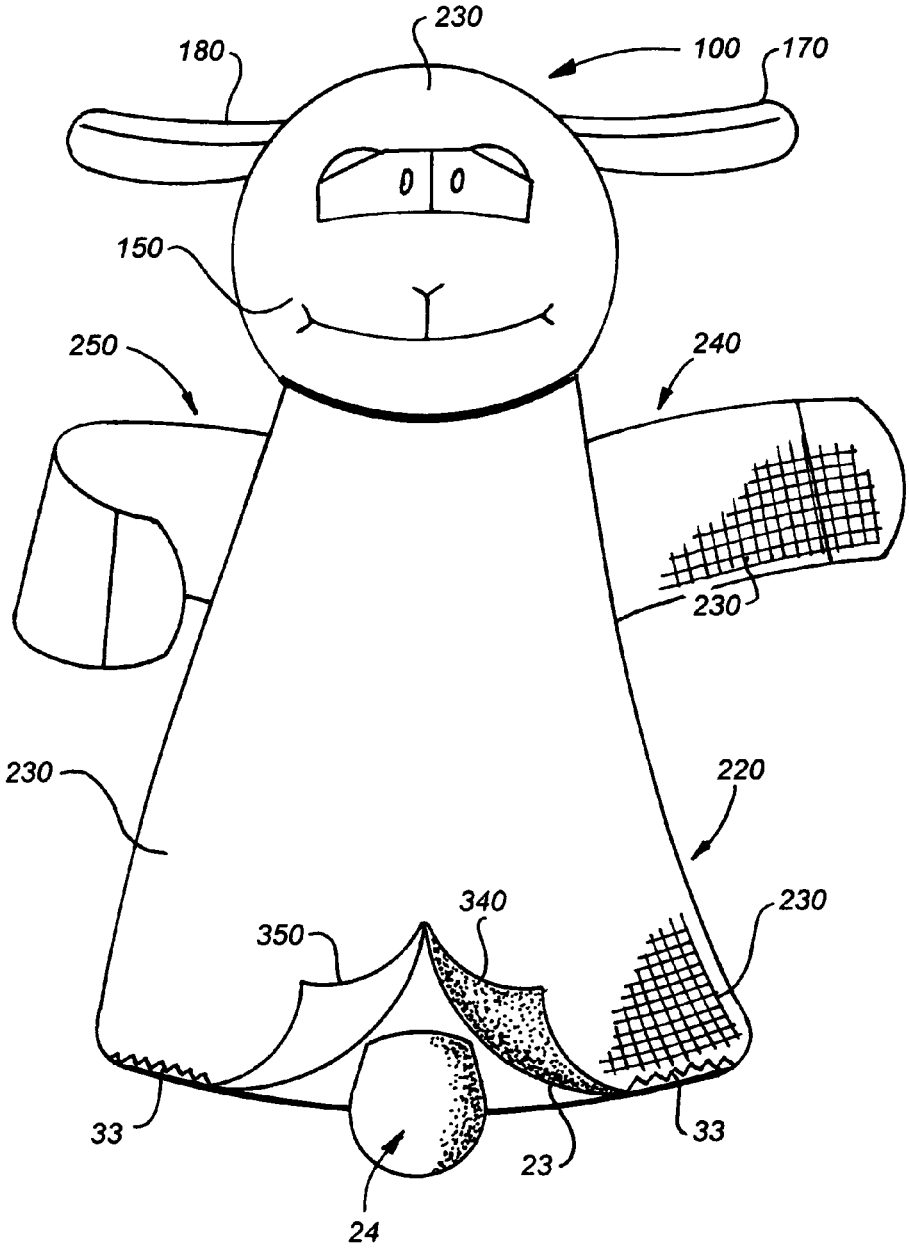
FIG. 11 is a front view of the second puppet character in a display configuration with the first puppet character in a storage configuration inside the second puppet character; and, FIG. 12 is a front view of the first puppet character ins a display configuration with the second puppet character in a storage configuration inside the first puppet character.

Turning now to the drawings, which illustrates the presently preferred embodiments of the invention for the purpose of illustration thereof, and not by way of limitation, and in which like reference characters refer to corresponding elements throughout the several views, FIG. 1 illustrates a head unit 10 and ovate neck band 14 that are utilized in a first puppet wolf character. FIGS. 9 and 11 illustrate the first puppet character fully assembled. The fully assembled second puppet lamb character is illustrated in FIG. 11.

As will be described below, the first and second puppet characters are attached to one another such that when the first puppet character is in a display configuration, the second puppet character is in a storage configuration inside the first puppet character; and, when the second puppet character is in a display configuration, the first puppet character is in a storage configuration inside the second puppet character. Adjusting the puppet toy of the invention to move simultaneously one of the puppet characters from the display configuration to the storage configuration and the other of the puppet characters from the storage configuration to the display configuration is accomplished by turning the toy inside-out.

The head unit 10 in FIG. 1 is depicted in the storage configuration with the face, including the nose 15 and tongue 16 of the wolf, turned inside the generally spheroidal exterior skin S1. The head unit 100 of the second puppet character has a similar spheroidal exterior skin S2 (FIG. 7) that is, when the second puppet character has not yet been connected to the first puppet character in the manner illustrated in FIG. 8, also like skin S1 visible when head unit 100 is in the storage configuration.

In FIG. 1, head unit 10 has a front 20, a rear 21, and a skin S1. The rear 21 of unit 10 is further depicted in FIG. 5. The skin S1 has secondary side 11 which in FIG. 1 is on the exterior of head unit 10. The face of the wolf is formed on the primary side 11A of the skin S1. As is illustrated in FIG. 2, the skin S1 circumscribes both a compressible resilient foam portion 12 and an open space, or hollow 13, that is adjacent the face of the wolf. The foam portion 12 is also adjacent the face of the wolf; as a result in FIG. 1 the face of the wolf is actually intermediate foam portion 12 and hollow 13. Foam portion 12 in part is shaped and dimensioned to conform to the face of the wolf, including the nose 15 that projects outwardly from the remainder of the wolf's face. The construction of head unit 100 is similar to that of head unit 10 in that head unit 100 also includes a compressible resilient foam portion that is adjacent the face of the lamb and include an open space, or hollow, that is also adjacent the face of the lamb in head unit 100. The foam portion in head unit 100 is, in part, also shaped and dimensioned to conform to the face of the lamb; however, since the face of the lamb is, although it is somewhat arcuate, relatively flat, the contour of the part of the form portion adjacent the face of the lamb is also relatively flat. As will be seen below, during operation of the toy, head unit 100 of the lamb character is stored in a hollow in head unit 10 when the wolf character is in the display mode illustrated in FIG. 12. Alternatively, when the lamb character is in the display mode illustrated in FIG. 11, the head unit 10 of the wolf character is stored in a hollow in head unit 100.

The face, including the nose 15, of the wolf character is displayed by inverting the head unit 10, i.e., by turning it inside-out. Head band 14 can resiliently stretch to facilitate turning head unit 10 inside out, but it is presently preferred that band 14, although pliable, be made of a fabric or other material that does not stretch. Unit 10 is turned inside-out by grasping band 14 with the index and other fingers of each hand and using the thumbs to press skin S1 and foam portion 12 downwardly through band 14 in the manner indicated by arrows A, B, C, and D in FIG. 1. In FIG. 3 skin S1 and foam portion 12 have been partially pressed through band 14 and the nose 15 and tongue 16 of the face of the wolf have begun to emerge below band 14. As the face of the wolf begins to emerge, head unit 10 is pivoted about the front edge 14A of band 14 in the manner indicated by arrow G and the entire face and head of the wolf emerge in the display configuration illustrated in FIG. 4, albeit with the back of the head of the wolf visible. If the head unit 10 in FIG. 4 is rotated one hundred and eighty degrees about a vertical axis, then the face of the wolf is visible in the manner illustrated in FIG. 6. The display orientation of head unit 10 (illustrated in FIG. 6) can be returned to the storage orientation of FIG. 1 by reversing the procedure just described. Adjustment of the head unit 100 between a display orientation (like that depicted in FIG. 11) and a storage orientation (like that illustrated in FIG. 7) is accomplished in the same manner as described above with respect to head unit 10.

Figure 6:
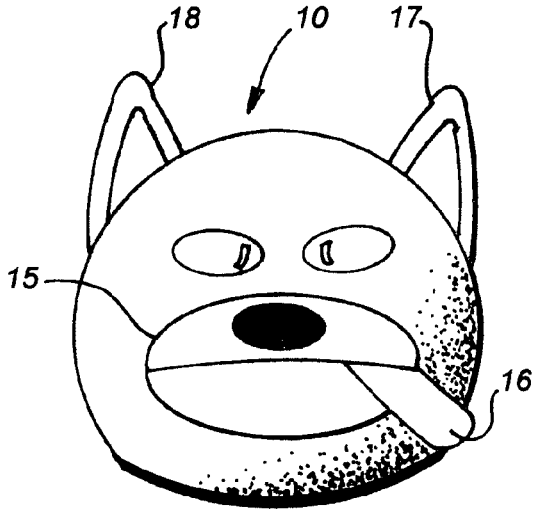
FIG. 6 is a front view of the head unit and ovate neck band of FIG. 4 illustrating further construction details thereof.

As would be appreciated by those of skill in the art, when head unit 10 is turned inside-out from the storage configuration of FIG. 1 to the display configuration of FIG. 6, a secondary hollow comparable in size to hollow 13 is produced. This secondary hollow is not, as is hollow 13, adjacent to the face of the wolf because in the display configuration the face of the wolf (formed on the primary surface 11A) appears and is displayed on the exterior of head unit 10. However, the secondary hollow is inside and circumscribed by skin S1 (as is hollow 13), is adjacent foam portion 12; and extends between the portions of exterior surface 11 found on the front 20 and rear 21 of head unit 10. When head unit 10 is inverted from the storage configuration of FIG. 1 to the display configuration of FIG. 6, the portions of exterior surface 11 on the front 20 and rear 21 of head unit 10 end up on the inside of unit 10 and are opposed and spaced apart from one another. The secondary hollow is between and separates these portion of exterior surface 11 on front 10 from the portion of exterior surface 11 on back 21. It is, as described below, this secondary hollow that receives head unit 100 of the lamb character when the wolf character is in the display configuration. Similarly, it is a secondary hollow in the head unit 100 that receives the head unit 10 of the wolf character when the lamb character is in the display configuration.

Head unit 10 is larger than the space circumscribed by neck band 14. Accordingly, when unit 10 is manipulated between the storage configuration and the display configuration, unit 10 must be compressed to fit through neck band 14. Such compression can be accomplished because skin S1 is pliable and portion 12 is fabricated from a compressible, resilient material such as, without limitation, a polymer foam. Head unit 100 is similarly constructed so that it can be compressed in order to git through neck band 140. It is presently preferred that sleeves 22 and 220, arms 24 and 25 and 240 and 250, skins S1 and S2, and the faces of the lamb and wolf characters be constructed of fabric, preferably a soft, non-abrasive fabric, although the materials used can vary as desired. In like fashion, when head unit 100 is fit into the secondary hollow in head unit 10, head unit 100 presently must be compressed in order to fit in the secondary hollow; and, head unit 10 must be compressed to fit in the secondary hollow in head unit 100.

Figure 7:
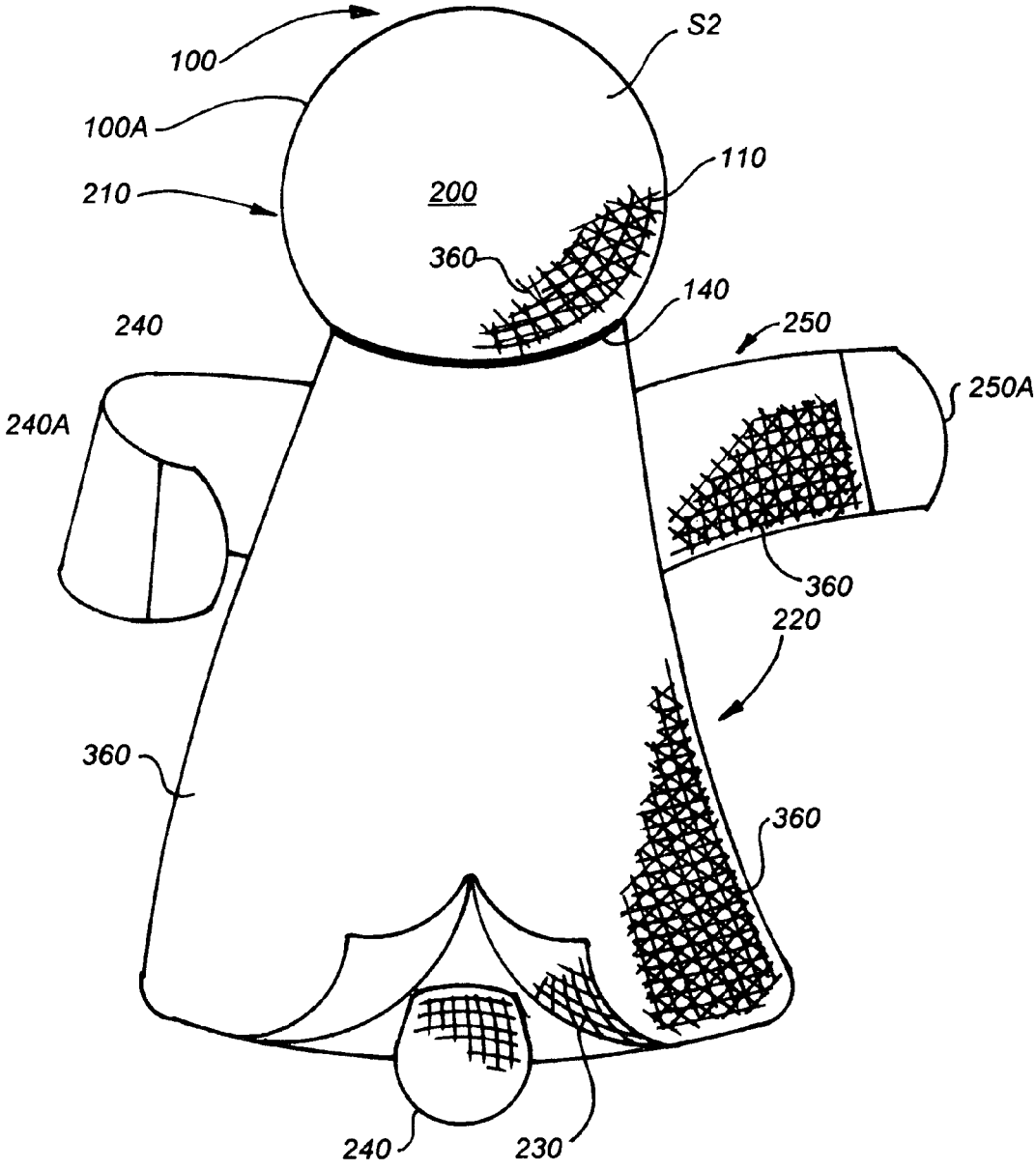
FIG. 7 is a front view of a second puppet character in a storage configuration.
Figure 8:
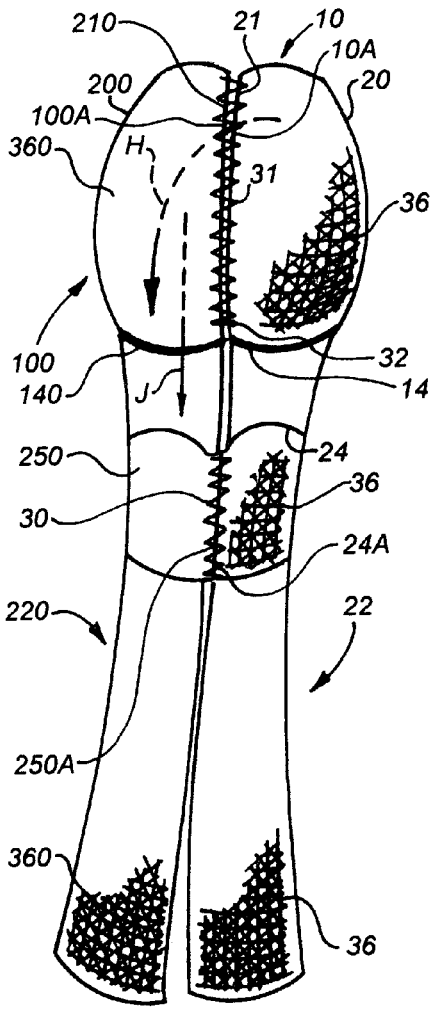
FIG. 8 is a side view illustrating the first and second puppet characters each in a storage configuration and appropriately secured to one another at selected points in accordance with the invention.
Figure 12:
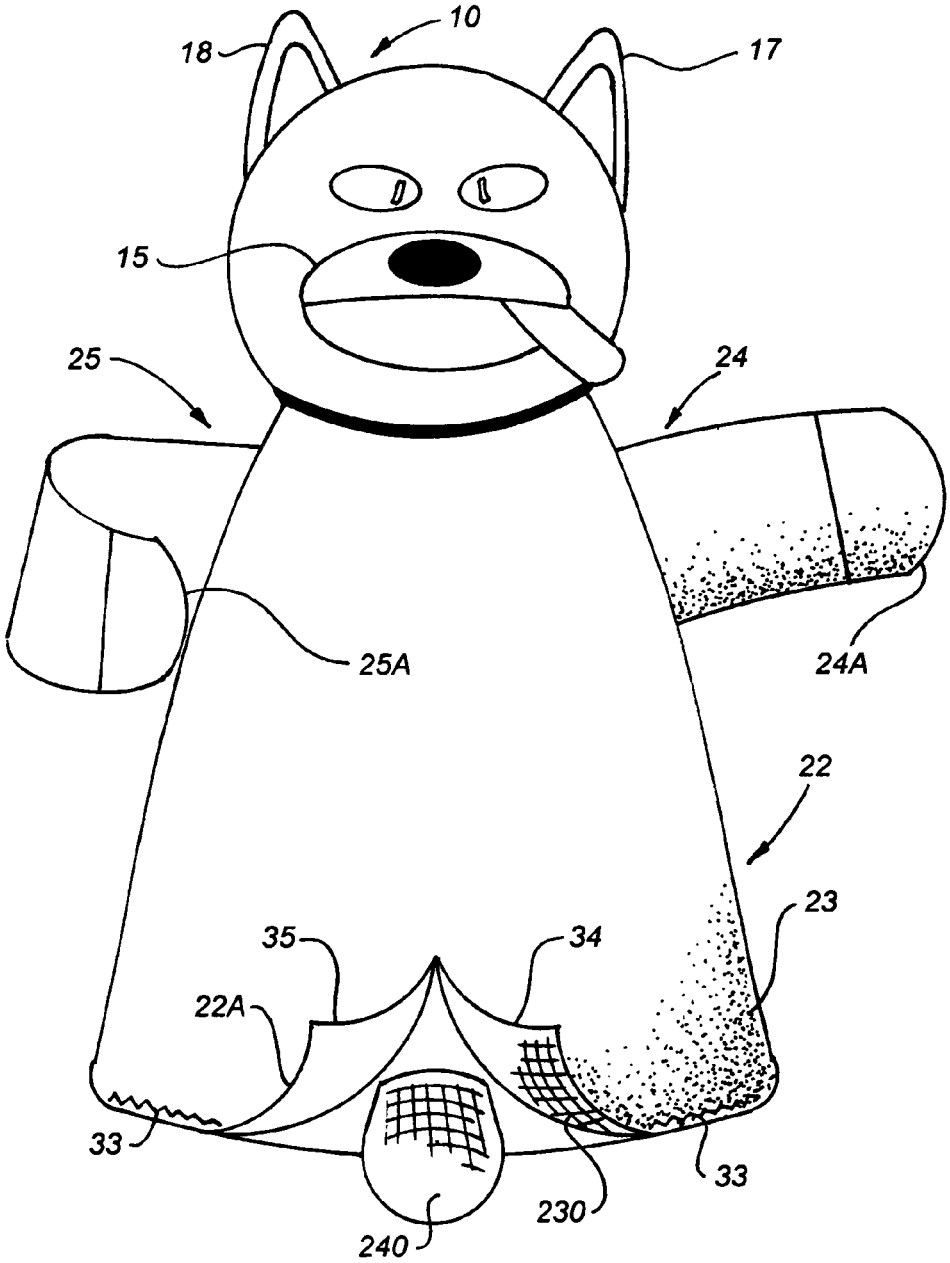

FIG. 7 illustrates the storage configuration for the lamb character, before the lamb character is joined with the wolf character to produce the toy of the invention. FIG. 11 illustrates the display configuration of the lamb character. FIG. 8 illustrates the storage configuration for both the lamb character and the wolf character, and illustrates the characters after they are stitched together. FIGS. 9 and 12 illustrates the display configuration of the wolf character.

In FIG. 7, the head unit 100 of the lamb character includes a front 200, a rear 210, and a skin S2. The skin S2 has secondary side 110 which in FIG. 7 is on the exterior of head unit 100. The face of the lamb is formed on the primary side of the skin S2. The primary side is on the side of skin S2 that is opposite and opposes the secondary side, in the same manner that primary side 11A is on the side of skin S1 that is opposite and opposes the secondary side 11. The skin S2 circumscribes a compressible resilient foam portion and an open space, or hollow, that is adjacent the foam portion. The foam portion is, in the same manner that foam portion is adjacent the face of the wolf, presently adjacent the face of the lamb and in part is shaped and dimensioned to conform to the face of the lamb.

Head unit is attached to pliable neck band 140, which is attached to hollow invertible sleeve 220. Conically shaped sleeve 220 circumscribes a first hollow space, includes a first open upper end which is attached to neck band 140, and includes an open lower end through which a user inserts his or her hand into the space circumscribed by sleeve 220. Sleeve 220 includes a primary display side 230 and includes a secondary side 360. Hollow arms 240, 250 similarly each include a primary display side 230 and a secondary side 360. The primary display side 230 of each arm 240, 250 is not visible in FIG. 7 but can be seen in FIGS. 10 and 11. Each arm 240, 250 is attached to sleeve 220 such that the open space in the inner end (i.e., the end adjacent sleeve 220) of each arm is in registration with and opens through an opening in sleeve 220 into the open space circumscribed by sleeve 220 so that when a user places his or her hand inside sleeve 220, the user can insert one finger into the open space in arm 250 and another finger into the open space in arm 240 so the user can use his or her fingers to move and manipulate arms 240, 250. In a similar manner, the open space (similar to open space 13) formed in head unit 100 opens through neck band 140 into the open space circumscribed by sleeve 220 so that a user can extend a finger(s) through neck band 140 into the open space in head unit 100 to move and manipulate head unit 100. The sleeve 22 and arms 24, 25 of the wolf character are constructed and operated in a manner similar to that just described for the lamb character. The lamb character includes a tail 240. The wolf character includes a tail 24. In FIG. 7, the bottom of sleeve 220 is shown slit like a woman's skirt—this only for the purpose of exposing tail 240 and the primary side 230. Although sleeve 220 can, if desired, be slit or formed in any desired configuration, in the presently preferred embodiments of the invention, sleeve 220 is not slit.

Figure 10:
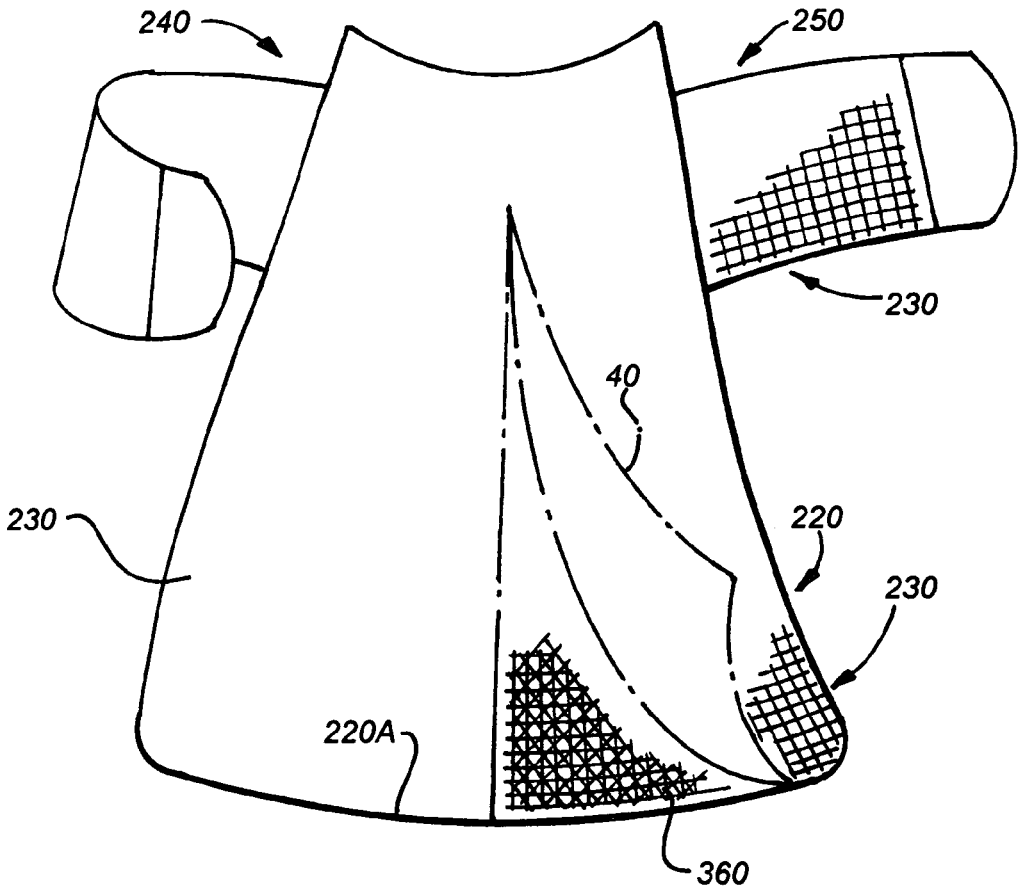
FIG. 10 is a front view of the sleeve and arms of the second puppet character in a display configuration.

In FIG. 10; the head unit 100 of the lamb character has been omitted. FIG. 10 illustrates the sleeve 220 and arms 240 and 250 after said sleeve 220 and arms 240, 250 in FIG. 7 have been inverted, i.e., turned inside-out. Accordingly, in FIG. 10 the sleeve 220 and arms 240 and 250 are in the display orientation and the display side 230 of the sleeve 220 and arms 240, 250 is on the exterior and is visible to a user while the secondary side 360 is concealed on the interior of sleeve 220 and arms 240, 250 and is not readily visible to a user. In FIG. 10, sleeve 220 is shown slit like a woman's skirt—this only for the purpose of exposing the secondary side 360. Although sleeve 220 can, if desired, be slit or formed in any desired configuration, in the presently preferred embodiments of the invention, sleeve 220 is not slit. Sleeve 220 includes lower edge, or hem, 220A (FIG. 10). Sleeve 22 includes lower edge, or hem, 22A (FIG. 12).

While the construction methodology used in the invention can vary as desired, it is presently preferred that the lamb character and wolf character each be separately constructed by forming the head unit 10 or 100, the sleeve 22 or 220, the arms 24, 25, 230, 250 and assembling such components. The lamb character and wolf character are each then placed in a storage configuration with the secondary sides 360, 36, respectively, on the exterior of the characters. The lamb character and wolf character are then placed with the head units 10, 100 back-to-back in the manner illustrated in FIG. 8. The outer peripheral edges 10A (FIG. 5) and 100A (FIG. 7) are then stitched 31 or otherwise attached together. The stitching 31 extends up the sides and over the tops of units 10 and 100. The stitching 31 does, however, stop at points 32 on either side of head units 10 and 100 that are near neck bands 14, 140. Neck bands 14, 140 must not be stitched together. As will soon be evident, the connection between hollow 13 and the space circumscribed by sleeve 22 in the wolf character must be maintained, as must the connection between the space circumscribed by sleeve 220 and the hollow in head unit 100 in the lamb character. In addition to stitching together head units 10, 100, the distal ends 24A, 250A of arms 24 and 250 are stitched 30 or otherwise attached to one another. The distal ends 25A, 240A of arms 25 and 240 are stitched or otherwise attached to one another.

Once stitching 30, 31 is completed, the toy is manipulated to achieve the display configuration illustrated in FIG. 11. This is accomplished as follows.

The first step is to invert the lamb character, i.e, turn it inside-out. This is achieved by first turning head unit 100 inside-out using a procedure equivalent to that earlier described with respect to FIGS. 1, 3, and 4. In essence, the head unit 100 is compressed and squeezed through the opening circumscribed by neck band 140 in the manner indicated by arrow J. At the same time, head unit 10 is compressed and is squeezed through neck band 140 and into the secondary hollow that is formed in head unit 10.

The second step is to invert sleeve 220. This is carried out by pulling it up over head unit 100 so that the primary display side 230 is visible and the secondary side is inside sleeve 220 and not readily visible.

The third step is to invert each arm 240, 250. This is performed by pulling or pushing, as desired, each arm from within sleeve 220 through openings formed in registration in sleeves 22, 220 to a position outside sleeve 220. Openings are, as noted, formed in sleeves 22, 220 so that the spaces or hollows in arms 24, 25 are in communication with the inner space circumscribed by sleeve 22. Arm 24 is inside arm 250. Arm 25 is inside arm 240.

Once the forgoing three steps are completed, the display configuration of FIG. 11 is realized. At that point the hems 22A and 220A are stitched 33 together and the assembly of the toy is complete. In the display configuration of FIG. 11, the wolf character is not visible because head unit 10 is concealed in the secondary hollow in head unit 100, because arms 24 and 25 are concealed in arms 250 and 240, respectively, and because sleeve 22 is concealed within sleeve 220. Pulling arm 24 (and its sister arm 250) through sleeves 22 and 220 requires a first opening to be formed in sleeve 22 that is in registration and alignment with a second opening formed in sleeve 220. Pulling arm 25 (and its sister arm 240) through sleeves 22 and 220 requires a third opening to be formed in sleeve 22 that is in registration and alignment with a fourth opening formed in sleeve 220.

The display configuration of FIGS. 9 and 12 is achieved by reversing the process that is described above to produce the display configuration of FIG. 11 from the configuration of FIG. 8. In brief, this would consist of compressing head unit 10, pressing head unit 10 out from head unit 100 through neck band 140, compressing head unit 110, pressing head unit 110 out through neck band 140, compressing head unit 10, pressing head unit 10 through neck band 14, compressing head unit 110, pressing head unit 110 through neck band 14 into the secondary hollow in head unit 10, inverting sleeve 220 over head unit 10 to expose primary display side 23 of sleeve 22, and inverting arms 24 and 25 by pulling each arm (along with its sister arm 250, 240, respectively) through registered opening pairs formed in sleeves 22, 220.

In use, the toy is placed in the display configuration of FIG. 11, a hand is placed inside the sleeves 220, 22, and fingers on the hand are used to move and manipulate arms 240 and 250 and head unit 100. The hand is removed from sleeves 220, 22 and the toy is placed in the display configuration of FIG. 12. The hand is placed inside the sleeves 22, 220, and fingers on the hand are used to move and manipulate arms 24 and 25 and head unit 10. One of the fingers on the hand typically extends into the secondary hollow in head unit 10 or 100, as the case may be, to enable a user to manipulate the head unit 10 or 100.

Having described my invention in such terms as to enable it to be made and used by those skilled in the art, and having described the presently preferred embodiments and best mode thereof, I claim:

1. A hand operated invertible toy comprising (a) a first hollow invertible sleeve circumscribing a first open space and having an open first upper end and an open first lower bottom hem end and shaped and dimensioned to receive a user's hand and including a first side and a second side;

(b) first and second invertible hollow arms (i) circumscribing a second open space and a third open space, respectively (ii) connected to said first sleeve such that said second and third open spaces each open into said first open space, (iii) each shaped and dimensioned to receive a different finger of a user's hand and including a first side and a second side, and (iv) having a distal end;

(c) a first ovate neck band connected to said first upper end of said first sleeve, circumscribing a first opening having a first selected size;

(d) a first pliable compressible resilient head unit including (i) a first pliable skin connected to and extending outwardly from said neck band, having a primary side and a secondary side, and having a face formed on said primary side, (ii) having a second size greater than said first selected size, (iii) a first compressible foam portion, said first head unit compressible to reduce resiliently said second size and pass through said neck band between two operative positions, (iv) a first operative position with said first face and said primary side concealed inside said skin, and said secondary side facing outwardly and visible to a user on the exterior of said first unit, and (v) a second operative position inside-out from said first operative position with said first face and said primary side facing outwardly and visible to a user on the exterior of said first unit, said secondary side concealed inside said skin, and, a first hollow circumscribed by said skin;

(e) a second hollow invertible sleeve circumscribing a fourth open space and having an open first upper end and an open first lower bottom hem end and shaped and dimensioned to receive a user's hand and including a first side and a second side;

(f) third and fourth invertible hollow arms (i) circumscribing a fifth open space and a sixth open space, respectively (ii) connected to said second sleeve such that said fifth and sixth open spaces each open into sad fourth open space, (iii) each shaped and dimensioned to receive a different finger of a user's hand and including a first side and a second side, and (iv) having a distal end;

(g) a second ovate neck band connected to said first upper end of said second sleeve, circumscribing a second opening having a third selected size;

(h) a second pliable compressible resilient head unit including (i) a second pliable skin connected to and extending outwardly from said second neck band, having a first side and a second side, and having a second face formed on said first side, (ii) having a fourth size greater than said third selected size, (iii) a second compressible foam portion, said second head unit compressible to reduce resiliently said fourth size to pass through said second opening of said second neck band between two operative positions, (iv) a primary operative position with said second face and said first side of said second skin concealed inside said second skin, and said second side facing outwardly and visible to a user on the exterior of said second head unit, and (v) a secondary operative position inside-out from said primary operative position with said second face and said first side facing outwardly and visible to a user on the exterior of said second head unit, said second side concealed inside said second skin, and a second hollow circumscribed by said second skin, said first head unit attached and opposed to said second head unit, said distal end of each of said first and second arms attached to said distal end of a different one of said third and fourth arms, and said hem end of said first sleeve attached to said hem end of said second sleeve such that said toy is invertible between two operative positions, (i) an initial operational position with said first face facing outwardly and visible and said second head unit inside said first head unit concealed in said first hollow in said first head unit and, (j) a second operational position with said second face facing outwardly and visible and said first head unit inside said second head unit concealed in said second hollow in said second head unit.

* * * * *